US009953737B2

(12) United States Patent
Tullholm

(10) Patent No.: US 9,953,737 B2
(45) Date of Patent: Apr. 24, 2018

(54) ELECTRICAL WIRE WITH A CENTRAL ALUMINUM WIRE SURROUNDED BY AT LEAST ONE COPPER WIRE

(71) Applicant: MEE INVESTMENT SCANDINAVIA AB, Bromma (SE)

(72) Inventor: Thomas Tullholm, Skarpnäck (SE)

( * ) Notice: Subject to any disclaimer, the term of this patent is extended or adjusted under 35 U.S.C. 154(b) by 0 days.

(21) Appl. No.: 15/424,915

(22) Filed: Feb. 6, 2017

(65) Prior Publication Data

US 2017/0162290 A1 Jun. 8, 2017

Related U.S. Application Data

(63) Continuation of application No. PCT/SE2015/050833, filed on Jul. 28, 2015.

(30) Foreign Application Priority Data

Aug. 5, 2014 (SE) ..... 1450925
Mar. 25, 2015 (SE) ..... 1550361

(51) Int. Cl.
*H01B 1/02* (2006.01)
*H01B 7/00* (2006.01)
*H01B 5/08* (2006.01)
*H01B 5/02* (2006.01)

(52) U.S. Cl.
CPC ..... *H01B 1/026* (2013.01); *H01B 1/023* (2013.01); *H01B 5/02* (2013.01); *H01B 5/08* (2013.01); *H01B 7/0009* (2013.01)

(58) Field of Classification Search
None
See application file for complete search history.

(56) References Cited

U.S. PATENT DOCUMENTS 1,700,476 A * 1/1929 Gilbert ..... H01B 11/143 174/105 R
1,821,887 A * 9/1931 Fowle ..... H01B 5/107 174/131 A
1,821,908 A * 9/1931 Fowle ..... H01B 5/10 428/377
2,001,319 A * 5/1935 Stanley ..... D07B 1/147 174/128.1
2,138,420 A * 11/1938 Grobl ..... H01B 5/104 174/128.1
2,778,870 A * 1/1957 Nolan ..... H01B 5/104 174/128.1
2,873,307 A * 2/1959 Horn ..... H01B 7/14 174/102 R
4,699,461 A * 10/1987 Taylor ..... G02B 6/4403 174/70 R (Continued)

*Primary Examiner* — Chau N Nguyen
*Assistant Examiner* — Muhammed Azam
(74) *Attorney, Agent, or Firm* — Gabriela B. Tomescu; Bergenstråhle & Partners AB

(57) ABSTRACT

An electrical wire comprises a central Aluminum wire, wherein the central Aluminum wire is surrounded by at least one Copper wire and the aluminum wire and the copper wire are uncoated such that the Copper wire is in direct contact with the central Aluminum wire. 3-23% by volume of the electrical wire is made of Aluminum and the rest is made of Copper. At least one of the central wire and the surrounding wire has a purity of at least 95% to provide a high degree of contact between Aluminum and Copper.

17 Claims, 2 Drawing Sheets

(56) References Cited

U.S. PATENT DOCUMENTS 4,777,324 A * 10/1988 Lee ..... H01B 7/0009 174/113 R
4,905,969 A * 3/1990 Kurschner ..... H01B 5/10 174/126.2
4,937,401 A * 6/1990 Lee ..... H01B 7/0009 174/113 C
4,980,517 A * 12/1990 Cardas ..... H01B 7/0009 174/129 R
6,180,232 B1 * 1/2001 McCullough ..... C22C 47/025 174/113 R
6,329,056 B1 * 12/2001 Deve ..... C22C 47/062 164/100
6,344,270 B1 * 2/2002 McCullough ..... C22C 47/08 164/100
6,518,505 B1 * 2/2003 Matsui ..... H01B 1/026 174/126.1
6,631,095 B1 * 10/2003 Bryant ..... H01B 7/045 174/113 R
7,728,229 B2 * 6/2010 Pyon ..... H01L 39/14 174/125.1
2002/0036092 A1 * 3/2002 Kikuchi ..... H01B 5/104 174/40 R
2002/0127401 A1 * 9/2002 Perego ..... C08F 255/02 428/375
2003/0124259 A1 * 7/2003 Kodas ..... C09D 11/30 427/376.6
2003/0124377 A1 * 7/2003 McCullough ..... C04B 41/009 428/611
2005/0121223 A1 * 6/2005 Wu ..... H01B 7/0009 174/126.1
2005/0279074 A1 * 12/2005 Johnson ..... H01B 13/0235 57/212
2005/0279526 A1 * 12/2005 Johnson ..... H01B 5/105 174/106 R
2005/0279527 A1 * 12/2005 Johnson ..... H01B 13/0235 174/106 R
2010/0263911 A1 * 10/2010 Watanabe ..... C23C 10/28 174/126.2
2010/0263912 A1 * 10/2010 Watanabe ..... C23C 26/00 174/126.2
2010/0282494 A1 * 11/2010 Horiike ..... H01B 7/0009 174/115
2012/0097419 A1 * 4/2012 Varkey ..... H01B 7/046 174/106 R
2012/0163758 A1 * 6/2012 McCullough ..... H01B 7/14 385/101
2014/0318858 A1 * 10/2014 Pourladian ..... D07B 1/147 174/70 R
2014/0345904 A1 * 11/2014 Nagahashi ..... B60R 16/0215 174/107
2015/0104641 A1 * 4/2015 Mhetar ..... H01B 1/023 428/366
2015/0155073 A1 * 6/2015 Varkey ..... H01B 7/046 174/105 R
2015/0194237 A1 * 7/2015 Ranganathan ..... H01B 5/002 174/40 R
2015/0200032 A1 * 7/2015 Saleh ..... H01B 1/023 174/126.2
2015/0235739 A1 * 8/2015 Davis ..... H01B 9/008 174/40 R
2015/0279518 A1 * 10/2015 Comoret ..... C22C 21/00 174/70 A

* cited by examiner

ELECTRICAL WIRE WITH A CENTRAL ALUMINUM WIRE SURROUNDED BY AT LEAST ONE COPPER WIRE

This application is the continuation of International Application No. PCT/SE2015/050833, filed 28 Jul 2015, which claims the benefit of Swedish Patent Applications No. SE 1450925- 1, filed 5 Aug. 2014, and SE 1550361- 8, filed 25 Mar. 2015, the entire contents of which are hereby incorporated by reference.

TECHNICAL FIELD

The present invention relates generally to an electrical wire. The invention also relates to an electrical cable.

BACKGROUND

Electrical wires come in many different forms. Typically it is the intended use of the wire that determines the design of an electrical wire. Some electrical wires are designed for power distribution others are designed for transmission of telecommunications signals and other signals or for other purposes.

Electrical wires are manufactured from a number of different materials such as Copper, Aluminum, Steel, and Nickel. Electrical wires are usually covered with insulating materials, such as plastic, rubber-like polymers, or varnish. Further wires can form cables. Typically, two or more wires can be joined to form a cable. Also, two or more wires may be wrapped concentrically, separated by insulation, to form a coaxial cable.

Regardless of the type of wire or cable it is typically desired that the electromagnetic field generated by the wire or cable is low when current runs in the wire/cable. For this purpose, the wire or cable can be shielded from the surroundings by one or many layers of electromagnetic shielding components. The cable can then, for example, be encased for its entire length in foil or wire mesh. All wires running inside this shielding layer will be to a large extent decoupled from external electric fields, particularly if the shield is connected to a point of constant voltage, such as earth.

For example U.S. Pat No. 3,683,103 describes an electrical wire designed to be of low weight. The electrical wire comprises coated strands of Aluminum and Copper. The coating on the strands, which is identical for all strands can be for example Silver or Nickel to prevent corrosion.

There is a constant desire to improve the performance of transmission of electrical power an electrical signals. In particular it is desired to reduce the electromagnetic field from a wire or a cable. Hence, there exists a need for an improved electrical wire and electrical cable.

SUMMARY OF INVENTION

It is an object of the present invention to provide an improved electrical wire and an improved electrical cable.

This object and/or others are met by the method and devices as set out in the appended claims.

As has been realized by the inventor it would be good if wires/cables were to emit reduced electromagnetic fields. This would reduce the need for electromagnetic shielding or completely remove the need for shielding and also reduce the electromagnetic interference between different electrical wires/cables. Other benefits potentially also exist, such as lower resistance.

By combining the physical properties of Copper and Aluminum, a wire generating significantly reduced electromagnetic field can be provided. This is obtained by surrounding an Aluminum wire with a Copper wire/Copper wires in direct contact with the Aluminum wire.

In accordance with one embodiment an electrical wire is provided. The electrical wire is formed by a central wire made from Aluminum. The central wire is surrounded by at least one wire of Copper in direct contact with the central wire.

In accordance with some embodiments the central wire is made from one solid wire of Aluminum.

In accordance with some embodiments the central wire is made from multiple wires of Aluminum, such as a stranded Aluminum wire.

In accordance with some embodiments, one or more Copper wires are twisted around the central wire. The Copper wire(s) can be twisted in two or more layers around the central wire. The central Aluminum wire and the surrounding Copper wires can in accordance with one embodiment form a stranded Copper Wire with a central wire of Aluminum.

The disclosure also extends to an electrical cable comprising one or more of the electrical wires set out above. Also a method for manufacturing such a wire/cable is described.

Using the wires/cables as described herein will provide electrical wires/cables that emit significantly lower electromagnetic fields than wires/cables that are conventionally used to day.

BRIEF DESCRIPTION OF THE DRAWINGS

The invention will now be described, by way of non-limiting examples, and with reference to the accompanying drawings, in which.

DESCRIPTION OF EMBODIMENTS

Figure 1:
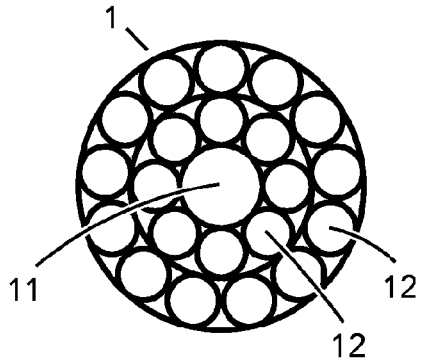
FIG. 1 is a view of an electrical wire in accordance with a first embodiment.

In the following, a detailed description of the invention will be given. In the drawing figures, like reference numerals designate identical or corresponding elements throughout the several figures. It will be appreciated that these figures are for illustration only and are not in any way restricting the scope of the invention.

In FIG. 1 a cross-sectional view of an electrical wire 1 in accordance with a first embodiment is shown. The electrical wire 1 is formed by a central core of Aluminum (Al) wire 11. Around the central wire core of Aluminum one or more Copper (Cu) wires 12 are provided. The Copper wire(s) can typically be twisted around the central Aluminum wire. The Al wire 11 and the Cu wire(s) 12 are in direct contact with each other. The direct contact between the Aluminum in the Aluminum wire and the Copper in the Copper wire will provide the desired properties as described in more detail below. The Al wire 11 and the Cu wire(s) are hence naked/un-coated to let the Copper and Aluminum be in direct contact with each other.

In the embodiment shown in FIG. 1 the Al wire 11 has a cross section area of about 0.35 $mm^2$ and the Cu wires 12 have a cross section area of about 0.20 $mm^{2}$. In accordance with some embodiments the core wire 11 of Aluminum is a solid wire having a larger cross sectional area than the individual surrounding wires 12 of Copper. The electrical wire 1 can be seen as a stranded Copper wire having a central wire made from Aluminum in the middle. The electrical wire 1 can be made in different dimensions. For example the cross section area of the electrical wire 1 can be 1.5 $mm^2$ or 2.5 $mm^2$ 6 $mm^2$ or any other dimension that suits the application in which the electrical wire 1 is to be used.

In accordance with some embodiments the ratio between Aluminum wire and Copper is 3-23% or 4-22% Aluminum by volume and the rest is Copper. In accordance with another embodiment the ratio between Aluminum wire and Copper is 6-21% Aluminum by volume and the rest is Copper. In accordance with another embodiment the ratio between Aluminum wire and Copper is 7-14% Aluminum by volume and the rest is Copper. In accordance with yet another embodiment the ratio between Aluminum wire and Copper is 13-14% Aluminum by volume and the rest is Copper.

It is preferred that the Aluminum wire and Copper Wire(s) are of high purity to have a good direct contact between the Aluminum in the Aluminum wire and the Copper of the Copper wire(s). This can act to improve the electromagnetic properties of the overall wire so that the electromagnetic field is reduced even further. For example Copper according to UNS C 10100 or C11 000 can be used. Also Aluminum according to EN573-3 can be used. It is preferred to use a Copper wire that has a purity of at least 95% in particular at least 99%. Similarly it is preferred to use an Aluminum wire that has a purity of at least 95% in particular at least 99%.

The number of Cu wires 12 can be any suitable number and the Cu wires 12 may be provided in one or more layers around the central core wire 11 of Aluminum. In the example shown in FIG. 1, 21 individual Copper wires 12 are twinned around an Aluminum core 11. The Copper wires are arranged in two different layers with 8 wires in an inner layer and 13 wires in an outer layer. The number of Copper wires used and in how many layers the Copper wires are arranged is a design matter and can be determined based on the application for which the wire is to be used.

To further improve the electromagnetic properties of the electrical wire 1, the Copper wires 12 can have different cross sectional areas, i.e. not all Copper wires have the same cross sectional area. By providing Copper wires with different cross sectional areas the contact area between the Aluminum in the Aluminum wire and the Copper in the Copper wires can be increased. A large contact area between Copper and Aluminum is likely to further improve the electromagnetic properties of the electrical wire so the electromagnetic field generated by the electrical wire is even further reduced. Another effect of providing Copper wires with different cross sectional areas is that the Copper wires will be more densely packed, which in it-self can act to improve the electrical wire. For example the electrical wire can then potentially be made thinner.

Figure 2:
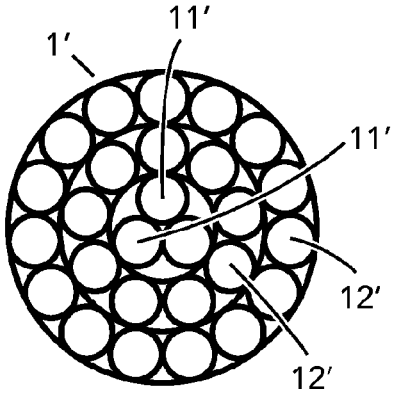
FIG. 2 is a view of an electrical wire in accordance with a second embodiment.

In FIG. 2 a cross-sectional view of an electrical wire 1' in accordance with a second embodiment is shown. The embodiment in FIG. 2 differs from the embodiment shown in FIG. 1 in that the central wire 11' is formed by more than one Aluminum wire 11'. Around the central wire 11' of Aluminum one or more Copper (Cu) wires 12' are twisted. The Al wires 11' and the Cu wire(s) 12' are in direct contact with each other. In accordance with some embodiments both the Aluminum wires 11' and the Copper wire(s) 12' are naked wires without any insulation. In the embodiment shown in FIG. 2, the Al wires 11' have a cross section area of about 0.20 $mm^2$ each and the Cu wires 12' each have a cross section area of about 0.20 $mm^{2}$. In accordance with some embodiments the core wires 11' of Aluminum is a stranded wire with individual wires having about the same cross sectional area as the surrounding wires 12' of Copper. The electrical wire 1' can be seen as a stranded Copper wire having a central wire formed as a stranded Aluminum wire in the middle.

The number of Cu wires 12' can be any suitable number and the Cu wires 12' may be provided in one or more layers around the core wire 11' of Aluminum. In the example shown in FIG. 2, 21 individual Copper wires 12' are twinned around an Aluminum core wires 11'. The Copper wires 11' are arranged in two different layers with 8 wires in an inner layer and 13 wires in an outer layer. The number of Copper wires used and in how many layers the Copper wires are arranged is a design matter and can be determined based on the application for which the wire is to be used. As with the electrical wire 1 in FIG. 1, the Copper wires and here also the Aluminum wires can have different cross sectional areas to increase the contact area between Copper and Aluminum.

The electrical wire configuration with a central wire of Aluminum in direct contact with Copper wire(s) will reduce the electromagnetic field generated when current flows in the electrical wire. It is preferred that the electrical wire only comprises a central wire made of Aluminum and Copper wire(s) twisted around the central wire and that no other conducting wires are provided. In particular an Aluminum wire/wires is only provided as a central wire and nowhere else in the electrical wire 1.

Figure 3:
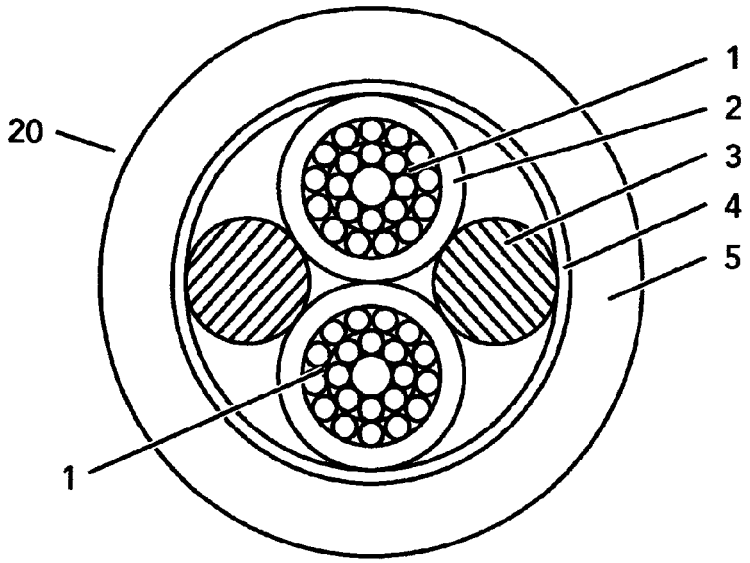
FIG. 3 is a view of an electrical cable.

In FIG. 3 a cross-sectional view of an electrical cable 20 comprising electrical wires 1 in accordance with the above is shown. In general the electrical wires 1 in FIG. 3 are wires with a core of Aluminum surrounded be Copper wire/wires in direct contact with each other. In the exemplary embodiment of FIG. 3 electrical wires 1 in accordance with the first embodiment described in conjunction with FIG. 1 having a solid central wire of Aluminum are used. However, cables can also be formed using the electrical wire 1' in accordance with the second embodiment described in conjunction with FIG. 2 having multiple central wires of Aluminum. In some embodiments a combination of different electrical wires of the type described herein can be used in the electrical cable when two or more electrical wires are provided in the one and same cable 20.

In FIG. 3 a cable 20 having two electrical wires 1 is shown. Cables having other number of electrical wires 1 can also be formed. In the exemplary embodiment in FIG. 3, the two electrical wires 1 can be a phase wire and a neutral wire of the cable 20. The cable 20 thus comprises two electrical wires 1. Each of the wires 1 is formed by a central wire of Aluminum surrounded by twisted Copper wires in direct contact with the central Aluminum wire. The central Aluminum wires 1 can be a solid wire as shown in FIG. 3 or the central Aluminum wire can be formed by multiple Aluminum wires. For example the central Aluminum wire can be a stranded Aluminum wire. The surrounding Copper wires in direct contact with the central Aluminum wire can be twisted around the central Aluminum wire. In some embodiments one or more of the electrical wires 1 is a stranded Copper wire having a central wire made from Aluminum. The central Aluminum wire can then for example be a solid Aluminum wire or a stranded Aluminum wire.

In the exemplary embodiment depicted in FIG. 3, each of the electrical wires 1 is provided with a jacket 2 of insulation. The jacket 2 can be of any suitable material such as a polymer based material for example TPS 130. The jacket 2 can be of any type used in existing cables. The insulation in the jacket 2 can for example be applied in a heated process to create an essentially air-tight insulation layer (a hermetic seal) around the electrical wire. Hereby oxidation of the Copper and Aluminum can be reduced or prevented. Further a filling material 3 can be provided in the cable 20. The filling material can be of any suitable type. In some embodiments the filling material is also of a polymer based material. The filling material 3 can be of any type used in existing cables. Around the insulated wires and the filling material a binder 4 can be provided. Outside the binder 4 an outer coating 5 can be provided. The cable 20 described in FIG. 3 has two electrical wires. It is however of course possible to design a cable with fewer or more wires depending on the application of the cable. Also the dimensions of the wires can differ in different cables depending on the intended field of use for the cable. The cable can for example be designed with 1, 2, 3, 4 or 5 electrical wires. Also the electrical wires 1 in a cable 20 with 2 or more electrical wires 1 can be twisted around each other. It is further possible to design the cable in accordance with any existing designs where the wires are formed as set out herein with Copper wire/wires surrounding an Aluminum wire in direct contact with the Aluminum wire.

Figure 4:
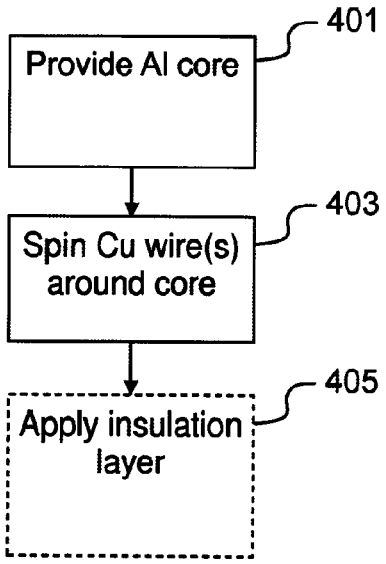
FIG. 4 is a flow chart illustrating steps performed when manufacturing an electrical wire/cable.

In FIG. 4 a flow chart illustrating some process steps performed when manufacturing an electrical wire in accordance with some exemplary embodiments of the electrical wire described herein. First, in a step 401, a central wire of Aluminum is provided. Next, in a step 403, a number of Copper wires are twisted around the central Aluminum wire. The Copper wires can be spun around the central Aluminum wire using a suitable method. For example a semi concentric stranding method can be used or a method generating bunched strands can be used. As set out above the Copper wires can also be provided in multiple layers, for example two, three or even more layers can be provided in some embodiments. The spinning method for different layers of Copper wires can differ. For example one layer can be applied with semi-concentric strands and another layer can be applied with bunched strands. The Copper wires can have different cross sectional areas. The cross sectional areas of the Copper wires can vary both within a layer and between different layers of Copper wires. The spinning direction of the layers can in some embodiment be the same for all layers of Copper wires. In one embodiment different layers of Copper wires have different spinning directions. The layer length of the layers can for example be 10-35 mm or 20-25 mm. If the electrical wire is to be insulated, an insulation layer is then applied in a step 405. The insulation layer can be applied using a heating process to provide an essentially air-tight insulation layer.

Because the wire/cable as described herein emits a very small electromagnetic field when a current runs in the electrical wire/cable, a cable can be formed without a shielding coating. Hence, in some embodiments no shielding layer is provided around the cable as described herein. The low electromagnetic field can be obtained by the Aluminum of the Aluminum wire in direct contact with the Copper of the Copper wire(s).

The wires/cables as described herein can be used in many fields. For example as alarm cables, signal cables, and cables for data communication. The cables can also be used as power supply cables in conventional power distribution systems up to 1000 V. Another field of application is a power distribution cable in the mid-voltage range from about 1 kV to 3 kV.

The invention claimed is:

1. An electrical wire comprising a central Aluminum wire, the central Aluminum wire being surrounded by at least one Copper wire, wherein the aluminum wire and the copper wire are un-coated to let the Copper wire be in direct contact with the central Aluminum wire, and 3-23% by volume of the electrical wire is Aluminum and the rest is Copper.

2. The electrical wire according to claim 1, wherein the central wire is one solid wire of Aluminum.

3. The electrical wire according to claim 1, wherein the central wire is formed by multiple wires of Aluminum.

4. The electrical wire according to claim 3, wherein the central wire is a stranded Aluminum wire.

5. The electrical wire according to claim 1, wherein multiple Copper wires are twisted around the central wire.

6. The electrical wire according to claim 5, wherein the multiple Copper wires are twisted in two or more layers around the central wire.

7. The electrical wire according to claim 5, wherein the central Aluminum wire and the surrounding Copper wires form a stranded Copper Wire with a central wire of Aluminum.

8. The electrical wire according to claims 5, wherein the Copper wires have different cross sectional areas, and not all of the multiple Copper wires have the same cross sectional area.

9. The electrical wire according to claim 1, wherein at least one of the central wire and the at least one surrounding wire has a purity of at least 95% to provide a high degree of contact between Aluminum and Copper.

10. The electrical wire according to claim 9, wherein at least one of the central wire and the at least one surrounding wire has a purity of at least 99% to provide a high degree of contact between Aluminum and Copper.

11. The electrical wire according to claim 1, wherein 7-14% by volume of the electrical wire is Aluminum and the rest is Copper.

12. An electrical cable comprising at least one electrical wire according to claim 1.

13. The electrical cable according to claim 12, wherein the at least one electrical wire is surrounded by a jacket of insulation.

14. The electrical cable according to claim 13, wherein the jacket of insulation is made from a polymer based material.

15. The electrical cable according to claim 13, wherein the jacket of insulation is essentially air-tight.

16. The electrical cable according to claim 13, wherein the cable further comprises one or more of: a filling material, a binder and an outer coating.

17. The electrical cable according to claim 13, wherein at least one of the central wire and the at least one surrounding wire has a purity of at least 95% to provide a high degree of contact between Aluminum and Copper.

* * * * *